US010638225B2

(12) United States Patent
Kim

(10) Patent No.: US 10,638,225 B2
(45) Date of Patent: Apr. 28, 2020

(54) TONE COMPENSATION DEVICE AND METHOD FOR EARSET

(71) Applicant: Orfeo SoundWorks Corporation, Anyang (KR)

(72) Inventor: Eundong Kim, Uiwang (KR)

(73) Assignee: Orfeo SoundWorks Corporation, Anyang (KR)

( * ) Notice: Subject to any disclaimer, the term of this patent is extended or adjusted under 35 U.S.C. 154(b) by 0 days.

(21) Appl. No.: 16/093,031

(22) PCT Filed: Nov. 30, 2016

(86) PCT No.: PCT/KR2016/013992
§ 371 (c)(1),
(2) Date: Oct. 11, 2018

(87) PCT Pub. No.: WO2017/183789
PCT Pub. Date: Oct. 26, 2017

(65) Prior Publication Data

US 2019/0075396 A1 Mar. 7, 2019

(30) Foreign Application Priority Data

Apr. 19, 2016 (KR) ..... 10-2016-0047634
May 9, 2016 (KR) ..... 10-2016-0056130

(51) Int. Cl.
*H04R 1/10* (2006.01)
*H04R 3/04* (2006.01)
(Continued)

(52) U.S. Cl.
CPC ..... *H04R 3/04* (2013.01); *G10L 25/51* (2013.01); *H04R 1/1041* (2013.01); *H04R 1/406* (2013.01); *H04R 3/00* (2013.01); *H04R 3/005* (2013.01)

(58) Field of Classification Search
CPC ..... H04R 3/04; H04R 1/1041; H04R 1/406; H04R 3/005; G10L 25/51
(Continued)

(56) References Cited

U.S. PATENT DOCUMENTS

2008/0175399 A1* 7/2008 Kim ..... H03G 3/32 381/57
2011/0293109 A1* 12/2011 Nystrom ..... G10L 21/038 381/94.2
(Continued)

FOREIGN PATENT DOCUMENTS

JP 2012208177 A * 10/2012
JP 2015-188177 A 10/2015
(Continued)

*Primary Examiner* — Ammar T Hamid
(74) *Attorney, Agent, or Firm* — Patent Office of Dr. Chung Park

(57) ABSTRACT

Disclosed are tone compensation device and method for an earset. A tone compensation device (method) for an earset, according to the present invention, is characterized by: extracting, in a parameter extraction unit, phase and amplitude parameters for each frequency from a voice signal transmitted from an in-ear microphone and an out-ear microphone; comparing, in a parameter comparison unit, the extracted phase and amplitude parameters for each frequency of the in-ear microphone and the extracted phase and amplitude parameters for each frequency of the out-ear microphone, respectively; and compensating, in a parameter compensation unit, for parameters having differentials between measurement values by means of the phase and amplitude parameter value for each frequency of the out-ear microphone.

5 Claims, 6 Drawing Sheets

(51) Int. Cl.

| | |
|---|---|
| ***H04R 3/00*** | (2006.01) |
| ***G10L 25/51*** | (2013.01) |
| ***H04R 1/40*** | (2006.01) |
| *H04R 25/00* | (2006.01) |

(58) Field of Classification Search
USPC ..... 381/74, 316; 704/233, 226
See application file for complete search history.

(56) References Cited

U.S. PATENT DOCUMENTS

2016/0078881 A1* 3/2016 Shin ..... G10L 21/038
381/74
2016/0241948 A1* 8/2016 Liu ..... H04M 1/19

FOREIGN PATENT DOCUMENTS

KR 10-0935769 B1 1/2010
KR 10-1092957 B1 12/2011
KR 10-2012-0105198 A 9/2012
KR 10-2015-0005924 A 1/2015

* cited by examiner

TONE COMPENSATION DEVICE AND METHOD FOR EARSET

TECHNICAL FIELD

The present invention relates to an earset, and more specifically, to a tone compensation device of an earset and a method thereof, which can compensate for a tone of a user.

BACKGROUND ART

Recently, earsets which integrate a speaker and a microphone in one body are proposed pretty much.

Such an earset may perform, in one body, a function of transferring sound to an ear canal and a function of collecting voices of a user. Therefore, generally, a speaker faces the ear canal for transfer of the sound, and the microphone is exposed to the outside to collect the voices of the user.

However, the microphone exposed to the outside collects external noises, as well as the voices of the user.

Therefore, an earset having a microphone (in-ear microphone) installed toward the ear canal has been proposed to solve the problem of external noise. However, the frequency of a voice transferred from the vocal cords to the eardrum through the Eustachian tube is in a low frequency band of about 0 to 2 KHz, and therefore, it is difficult to restore the original sound only from the sound of a low frequency band inputted into the in-ear microphone.

To solve the problem of losing high frequency bands, a technique of configuring a plurality of microphones and restoring an original sound by synthesizing voices of different frequency bands inputted into the microphones has been proposed. That is, an original sound is restored by configuring an in-ear microphone installed on the ear canal side, together with an out-ear microphone installed on the outside of an earflap, and synthesizing voices of different frequency bands inputted from the in-ear microphone and the out-ear microphone.

However, the characteristic of inner sound transferred from the vocal cords to the eardrum of an ear is different from user to user. Therefore, when the same high frequency sound restoration algorithm is applied, there is a problem in that a sound different from the real voice of a user may be restored.

Therefore, the restoration algorithm needs to be improved considering the characteristic of the inner sound that is different from user to user.

DISCLOSURE OF INVENTION

Technical Problem

An object of the present invention to provide a tone compensation device of an earset and a method thereof, which can compensate for a tone of a user by comparing voices inputted from an in-ear microphone and an out-ear microphone.

Technical Solution

To accomplish the above object, according to one aspect of the present invention, there is provided a tone compensation device for an earset, the device comprising: an in-ear microphone for collecting inner sound transferred from vocal cords to an eardrum of an ear; an out-ear microphone for collecting outer sound transferred from the vocal cords to an outside of a mouth; and a voice restoration unit for restoring a voice by comparing parameters of voice signals transferred from the in-ear microphone and the out-ear microphone.

At this point, the tone compensation device for an earset may further comprise a band extension unit for extending a band width of a voice signal outputted from the in-ear microphone and a voice signal outputted from the voice restoration unit.

Meanwhile, a tone compensation device for an earset comprises: an in-ear microphone for collecting inner sound transferred from vocal cords to an eardrum of an ear; a band extension unit for extending a band width from inner sound of a low frequency band to inner sound of a high frequency band; an out-ear microphone for collecting outer sound transferred from the vocal cords to an outside of a mouth; and a voice restoration unit for restoring a voice by comparing parameters of a voice signal outputted from the band extension unit and a voice signal transferred from the out-ear microphone.

Here, the voice restoration unit may include: a parameter extraction unit for extracting a plurality of parameters from the transferred voice signals; a parameter comparison unit for comparing measurement values of each parameter; and a parameter compensation unit for compensating for a parameter having a difference between the measurement values with a parameter value of the out-ear microphone, wherein the parameter includes a phase and an amplitude of each frequency of the voice.

On the other hand, a tone compensation method of an earset of the present invention comprises the steps of: collecting inner sound transferred from vocal cords to an eardrum of an ear, by an in-ear microphone, and collecting outer sound transferred from the vocal cords to an outside of a mouth, by an out-ear microphone; extracting phase and amplitude parameters of each frequency from voice signals transferred from the in-ear microphone and the out-ear microphone, by a parameter extraction unit; comparing the extracted phase and amplitude parameters of each frequency of the in-ear microphone with the extracted phase and amplitude parameters of each frequency of the out-ear microphone, by the parameter comparison unit; and compensating for a parameter having a difference between measurement values with phase and amplitude parameter values of each frequency of the out-ear microphone, by a parameter compensation unit.

At this point, the tone compensation method of an earset may further comprise the step of extending a band width of the voice signal outputted from the in-ear microphone and the voice signal outputted from the parameter compensation unit, by the band extension unit.

Meanwhile, a tone compensation method of an earset of the present invention comprises the steps of: collecting inner sound transferred from vocal cords to an eardrum of an ear, by an in-ear microphone, and collecting outer sound transferred from the vocal cords to an outside of a mouth, by an out-ear microphone; extending a band width from a voice signal of the in-ear microphone to a voice signal of a high frequency band, by a band extension unit; extracting phase and amplitude parameters of each frequency from voice signals transferred from the band extension unit and the out-ear microphone, by a parameter extraction unit; comparing the extracted phase and amplitude parameters of each frequency of the band extension unit with the phase and amplitude parameters of each frequency of the out-ear microphone, by a parameter comparison unit; and compensating for a parameter having a difference between measurement values with phase and amplitude parameter values of each frequency of the out-ear microphone, by a parameter compensation unit.

Advantageous Effects

As described above, according to a tone compensation device of an earset and a method thereof according to the present invention, since a tone of a user is restored by comparing voices inputted from an in-ear microphone and an out-ear microphone, comfort may be provided in the conversation between a user and a counterpart.

BEST MODE FOR CARRYING OUT THE INVENTION

Figure 1:
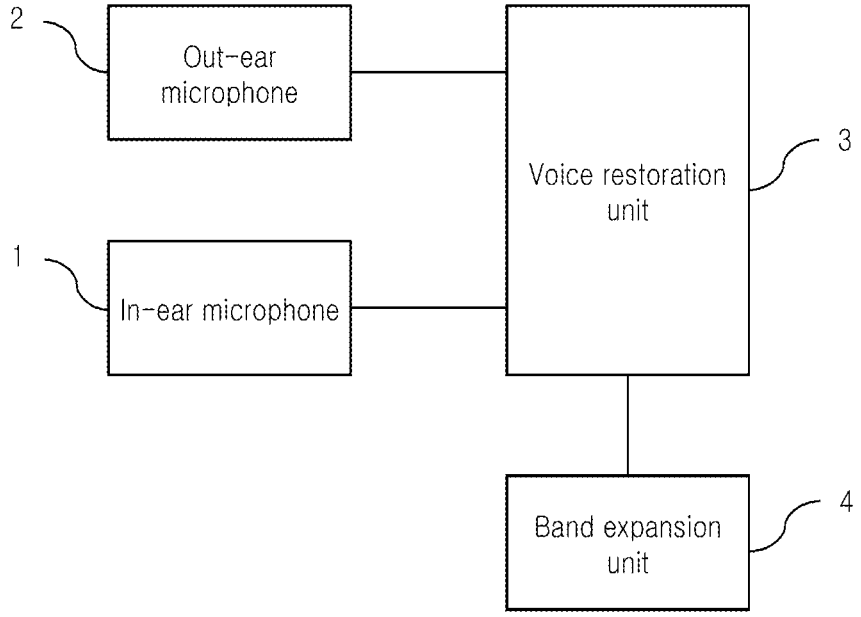
FIG. 1 is a view showing the configuration of a tone compensation device of an earset according to an embodiment of the present invention.

The present invention will be hereafter described in detail with reference to the preferred embodiments of the present invention and the accompanying drawings, and it will be described assuming that elements having like functions will be denoted by like reference numerals.

When it is referred that an element "includes" another element in the detailed description or claims of the present invention, it should be understood that this is not interpreted as being configured of only the corresponding element, but may further include other elements, as far as an opposed description is not specially specified.

In addition, in the detailed description or claims, a component named as "~means", "~unit", "~module" or "~block" means a unit of processing at least one function or operation, and each of these may be implemented by software, hardware or a combination of these.

Hereinafter, an example of implementing a tone compensation device of an earset and a method thereof according to the present invention will be described through a specific embodiment.

FIG. 1 is a view showing the configuration of a tone compensation device of an earset according to an embodiment of the present invention.

Referring to FIG. 1, a tone compensation device of an earset of the present invention includes: an in-ear microphone 1 for collecting inner sound transferred from the vocal cords to the eardrum of an ear; an out-ear microphone 2 for collecting outer sound transferred from the vocal cords to the outside of the mouth; and a voice restoration unit 3 for restoring a voice by comparing parameters of voice signals transferred from the in-ear microphone 1 and the out-ear microphone 2.

Here, the tone compensation device of an earset of the present invention may further include a band extension unit 4 for extending the band width of the voice signal outputted from the in-ear microphone 1 and the voice signal outputted from the voice restoration unit 3.

Figure 2:
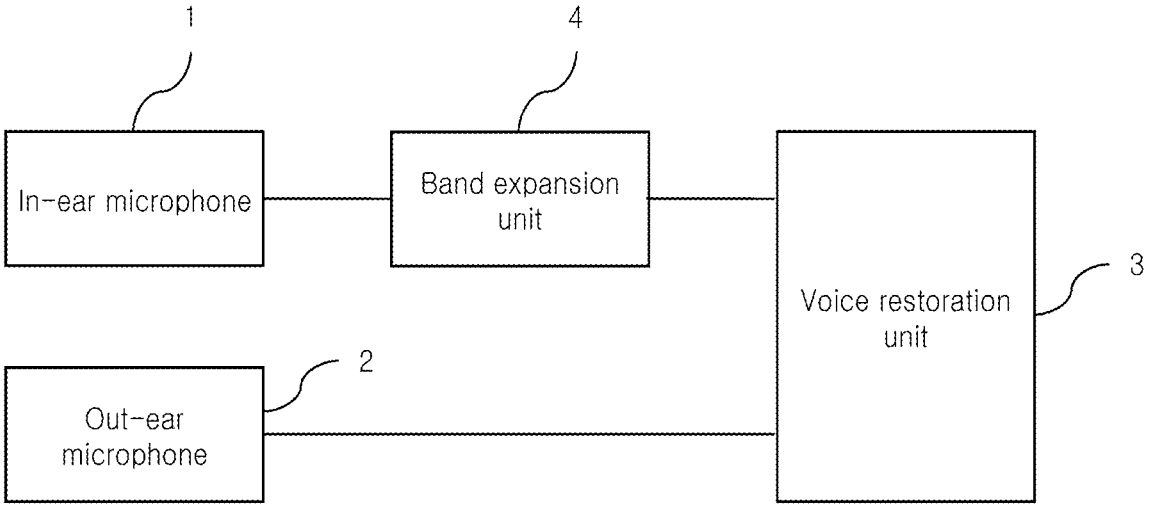
FIG. 2 is a view showing the configuration of a tone compensation device of an earset according to another embodiment of the present invention.

FIG. 2 is a view showing the configuration of a tone compensation device of an earset according to another embodiment of the present invention.

Referring to FIG. 2, the tone compensation device of an earset of the present invention includes: an in-ear microphone 1 for collecting inner sound transferred from the vocal cords to the eardrum of an ear; a band extension unit 4 for extending the band width from inner sound of a low frequency band to inner sound of a high frequency band; an out-ear microphone 2 for collecting outer sound transferred from the vocal cords to the outside of the mouth; and a voice restoration unit 3 for restoring a voice by comparing parameters of a voice signal outputted from the band extension unit 4 and a voice signal transferred from the out-ear microphone 2.

Figure 3:
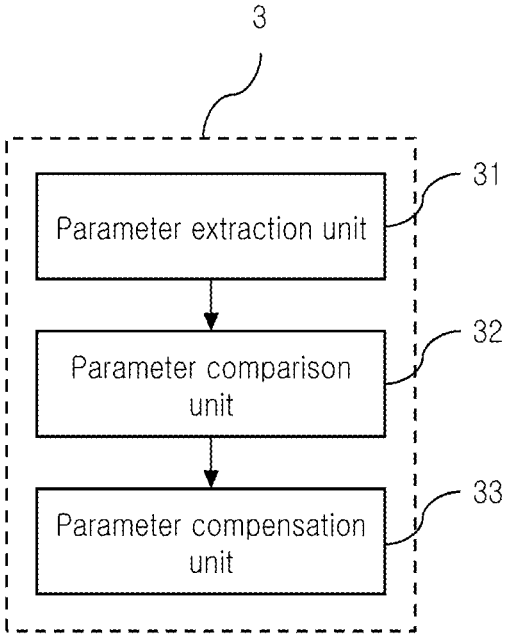
FIG. 3 is a view showing the configuration of a voice restoration unit according to an embodiment of the present invention.

FIG. 3 is a view showing the configuration of a voice restoration unit of the present invention.

Referring to FIG. 3, the voice restoration unit 3 of the present invention includes: a parameter extraction unit 31 for extracting a plurality of parameters from the voice signals transferred from the in-ear microphone 1 and the out-ear microphone 2; a parameter comparison unit 32 for comparing measurement values of each parameter of the in-ear microphone 1 and the out-ear microphone 2; and a parameter compensation unit 33 for compensating for a parameter having a difference between the measurement values with a parameter value of the out-ear microphone 2.

Here, the parameters include a phase and an amplitude of each frequency of a voice. That is, the parameters are extracted from the components of a sinusoidal signal including a phase and an amplitude of each frequency.

The parameter extraction unit 31 described above may be configured in each of the in-ear microphone 1 and the out-ear microphone 2.

Meanwhile, although a case of comparing parameters related to a voice in real-time is described, the comparison between parameters can be accomplished through comparison with a memory in which reference values of the parameters are stored. Therefore, a process for setting the reference value of each parameter may be performed.

The voice restoration unit 3 of the present invention configured like this extracts phase and amplitude parameters of each frequency from the voice signal transferred from each of the in-ear microphone 1 and the out-ear microphone 2. The extracted phase and amplitude parameters of each frequency of the in-ear microphone 1 are compared with the extracted phase and amplitude parameters of each frequency of the out-ear microphone 2, and a parameter having a difference between measurement values is compensated with the phase and amplitude parameter values of each frequency of the out-ear microphone 2.

Figure 4:
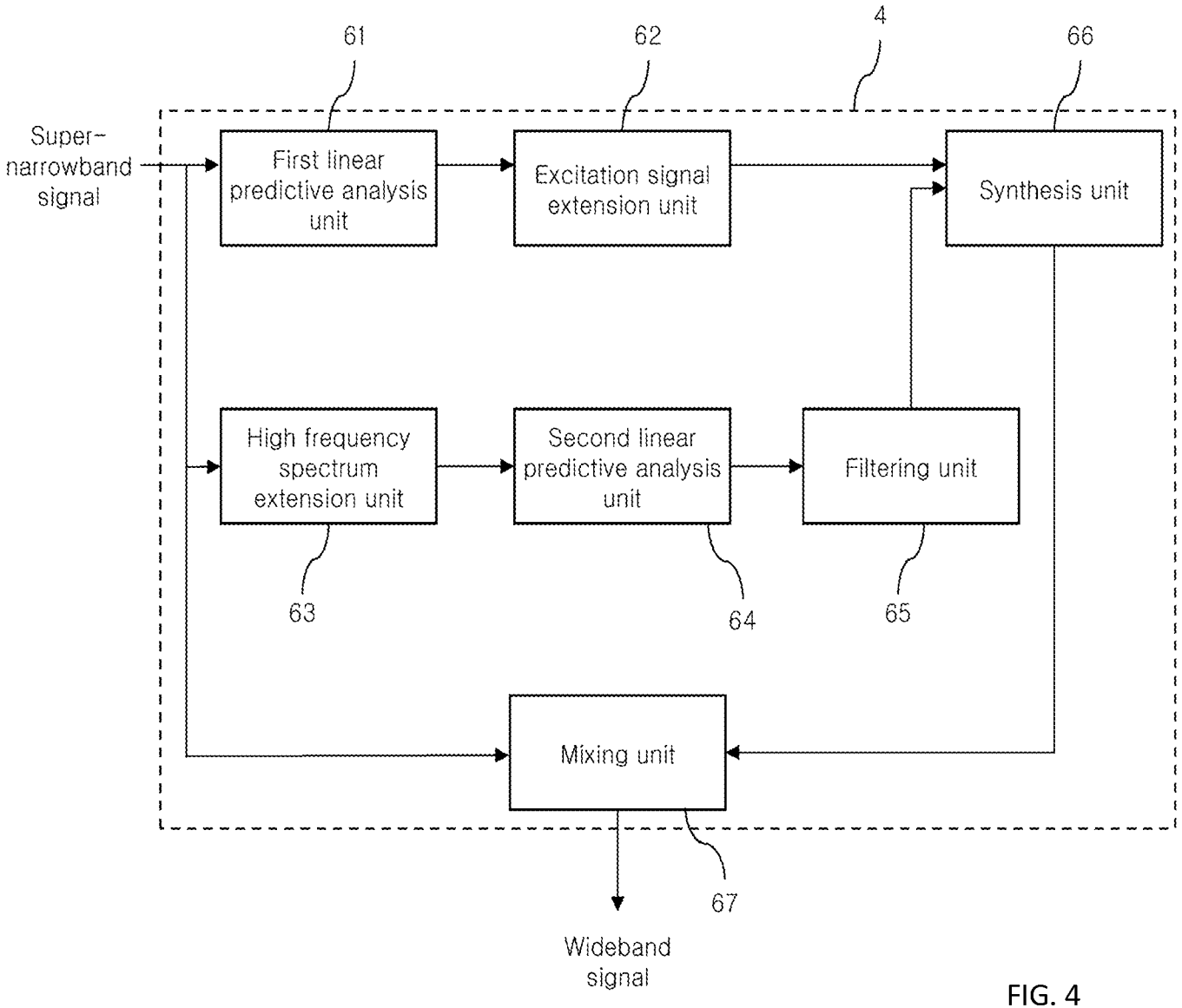
FIG. 4 is a view showing the configuration of a band extension unit according to an embodiment of the present invention.

FIG. 4 is a view showing the configuration of a band extension unit according to an embodiment of the present invention.

Referring to FIG. 4, the band extension unit 4 of the present invention includes: a first linear predictive analysis unit 61 for determining an excitation signal from an inputted super-narrowband signal; an excitation signal extension unit 62 for generating a sound by outputting the determined excitation signal as a wideband excitation signal through a spectrum folding technique or a Gaussian noise pass band conversion technique; a high frequency spectrum extension unit 63 for extending the super-narrowband signal as a wideband signal including a high frequency band signal by multiplying (N times) the frequency of the super-narrowband signal; a second linear predictive analysis unit 64 for predicting and determining the high frequency band signal from the extended wideband signal; a filtering unit 65 for filtering the high frequency band signal outputted from the second linear predictive analysis unit 64; a synthesis unit 66 for synthesizing the high frequency band signal outputted from the filtering unit 65 and the wideband excitation signal outputted from the excitation signal extension unit 62; and a mixing unit 67 for mixing a high frequency signal outputted from the synthesis unit 66 and the super-narrowband signal. Like this, the band extension unit 4 of the present invention is configured of a high frequency signal generation unit for generating a high frequency signal by synthesizing an excitation signal extended from an inputted super-narrowband signal and a high frequency band signal extended and filtered after multiplying the frequency of the super-narrowband signal, and the mixing unit 67 for mixing the high frequency signal and the super-narrowband signal.

The high frequency spectrum extension unit 63 is an example, and if a super-narrowband signal (0 to 2 KHz) is up-sampled two times, the up-sampled signal is sampled at 4 KHz. Therefore, the signal outputted from the high frequency spectrum extension unit 63 is in 0 to 4 KHz band and has a spectrum the same as that of a folded version of an input signal in a high frequency band of 4 to 8 KHz. The high frequency band signal is predicted using the spectrum. Therefore, the filtering unit 65 extracts a voice signal of 4 to 8 KHz band. Then, a voice signal of 0 to 4 KHz band and a voice signal of 4 to 8 KHz are synthesized by the synthesis unit 66, and subsequently, a high frequency band is finally restored by mixing the high frequency voice outputted from the synthesis unit 66 and the super-narrowband signal (0 to 2 KHz) before the extension.

Like this, the band extension unit 4 of the present invention makes it possible to restore a high frequency band signal although a super-narrowband signal is inputted into the in-ear microphone 1. That is, although a high frequency sound restoration algorithm generally extends a band of 0 to 4 KHz up to 8 KHz, even a super-narrowband signal of less than 2 KHz inputted into the in-ear microphone 1 is restored in the present invention. Furthermore, in the present invention, a high frequency band signal can be restored although the amount of computation is remarkably reduced.

In the present invention, an operation of predicting and extending a frequency through an algorithm based on linear predictive coding is not performed, and simple frequency extension is accomplished through high frequency spectrum extension. That is, an operation of predicting and extending a frequency in real-time is omitted, and only the frequency is extended using a rectifier, spectral folding and a modulation technique. Therefore, the amount of computation can be greatly reduced.

If the high frequency spectrum extension unit 63 outputs a wideband signal by simply extending only the frequency like this, a linear predictive analysis is performed thereon, and only simple filtering is performed using a filter without performing frequency extension through linear predictive modeling. That is, filtering of a signal close to an original sound (high frequency band) is accomplished without extension of bandwidth. Then, if a result of the filtering is synthesized with a result of extending the excitation signal, a high frequency signal is generated. Subsequently, if the high frequency signal is finally mixed with the super-narrowband signal received through the in-ear microphone 1, a high frequency band signal is restored.

Then, a tone compensation method of an earset of the present invention using the system configured as described above will be described herein.

Figure 5:
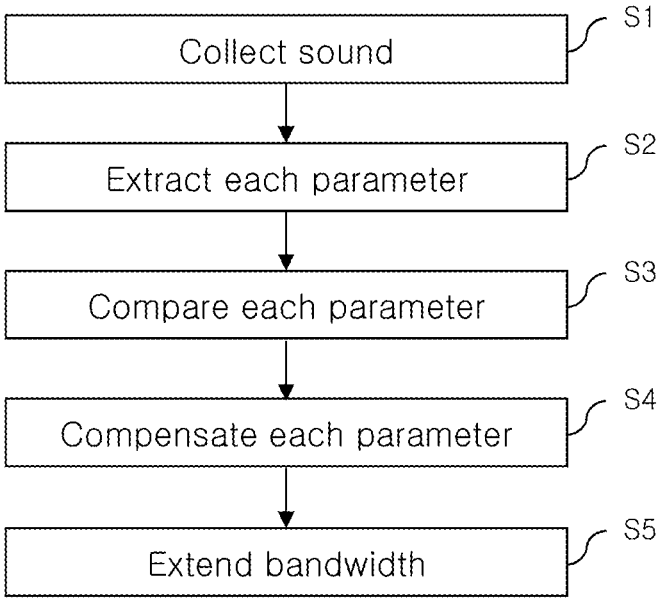
FIG. 5 is a flowchart illustrating a tone compensation method of an earset according to an embodiment of the present invention.

FIG. 5 is a flowchart illustrating a tone compensation method of an earset according to an embodiment of the present invention.

Referring to FIG. 5, if a user makes a voice, the in-ear microphone collects inner sound transferred from the vocal cords to the eardrum of an ear, and the out-ear microphone 2 collects outer sound transferred from the vocal cords to the outside of the mouth (step S1).

Then, the parameter extraction unit 31 extracts phase and amplitude parameters of each frequency from the voice signals transferred from the in-ear microphone 1 and the out-ear microphone 2 (step S2).

Subsequently, the parameter comparison unit 32 compares the extracted phase and amplitude parameters of each frequency of the in-ear microphone 1 with the extracted phase and amplitude parameters of each frequency of the out-ear microphone 2 (step S3).

Then, the parameter compensation unit 33 compensates for a parameter having a difference between measurement values with phase and amplitude parameter values of each frequency of the out-ear microphone 2 (step S4).

Meanwhile, the band extension unit 4 may further perform the step of extending the band width of the voice signal outputted from the in-ear microphone 1 and the voice signal outputted from the parameter compensation unit 33 (step S5).

Figure 6:
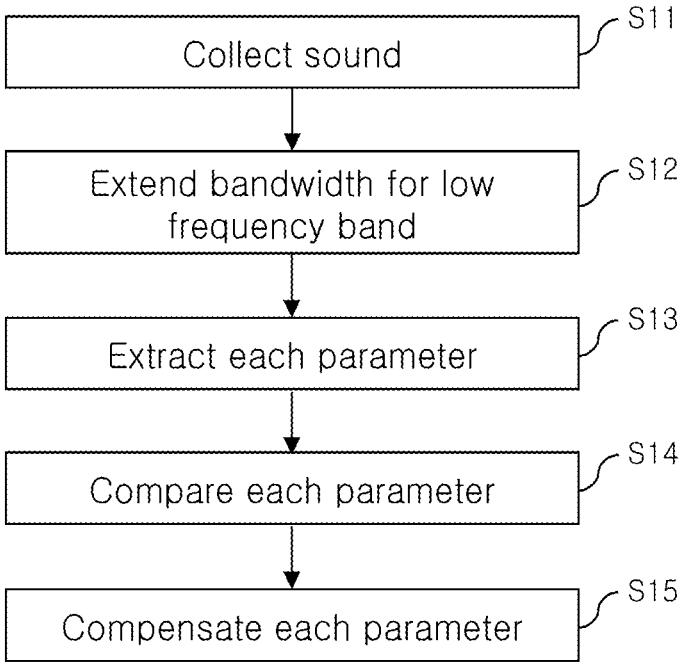
FIG. 6 is a flowchart illustrating a tone compensation method of an earset according to another embodiment of the present invention.

FIG. 6 is a flowchart illustrating a tone compensation method of an earset according to another embodiment of the present invention.

Referring to FIG. 6, if a user makes a voice, the in-ear microphone collects inner sound transferred from the vocal cords to the eardrum of an ear (step S11), and the band extension unit 4 extends the band width from the inner sound of a low frequency band to inner sound of a high frequency band (step S12). Meanwhile, the out-ear microphone 2 also collects outer sound transferred from the vocal cords to the outside of the mouth (step S11).

Subsequently, the parameter extraction unit 31 extracts phase and amplitude parameters of each frequency from the voice signals transferred from the band extension unit 4 and the out-ear microphone 2 (step S13).

Then, the parameter comparison unit 32 compares the extracted phase and amplitude parameters of each frequency of the band extension unit 4 with the phase and amplitude parameters of each frequency of the out-ear microphone 2 (step S14).

Then, the parameter compensation unit 33 compensates for a parameter having a difference between measurement values with phase and amplitude parameter values of each frequency of the out-ear microphone 2 (step S15).

Figure 7:
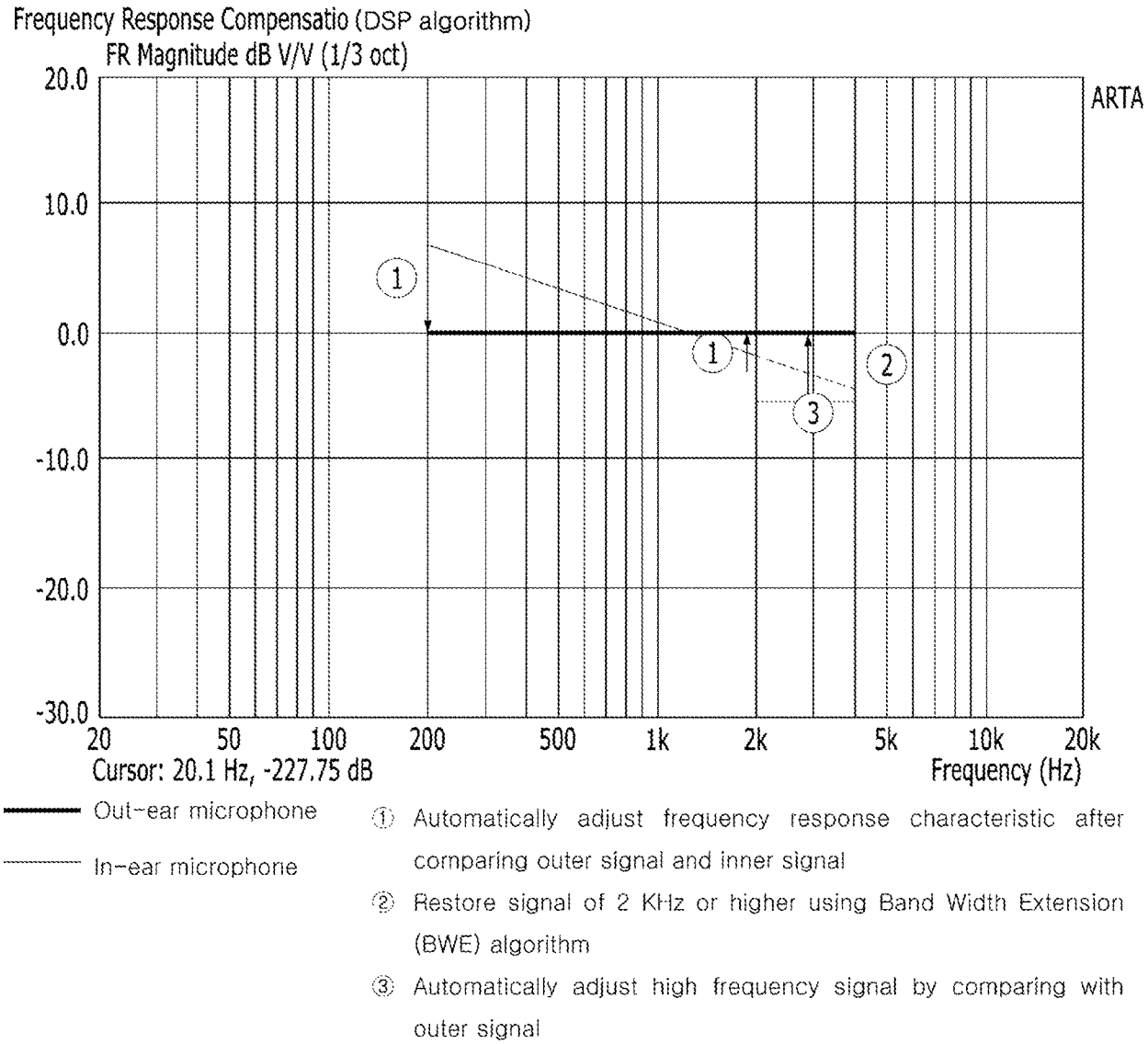
FIG. 7 is a view showing the concept of tone compensation of the present invention.

FIG. 7 is a view showing the concept of tone compensation of the present invention.

Referring to FIG. 7, in the present invention, a process of adjusting a frequency response characteristic by comparing an external signal and an internal signal is performed.

Figure 8:
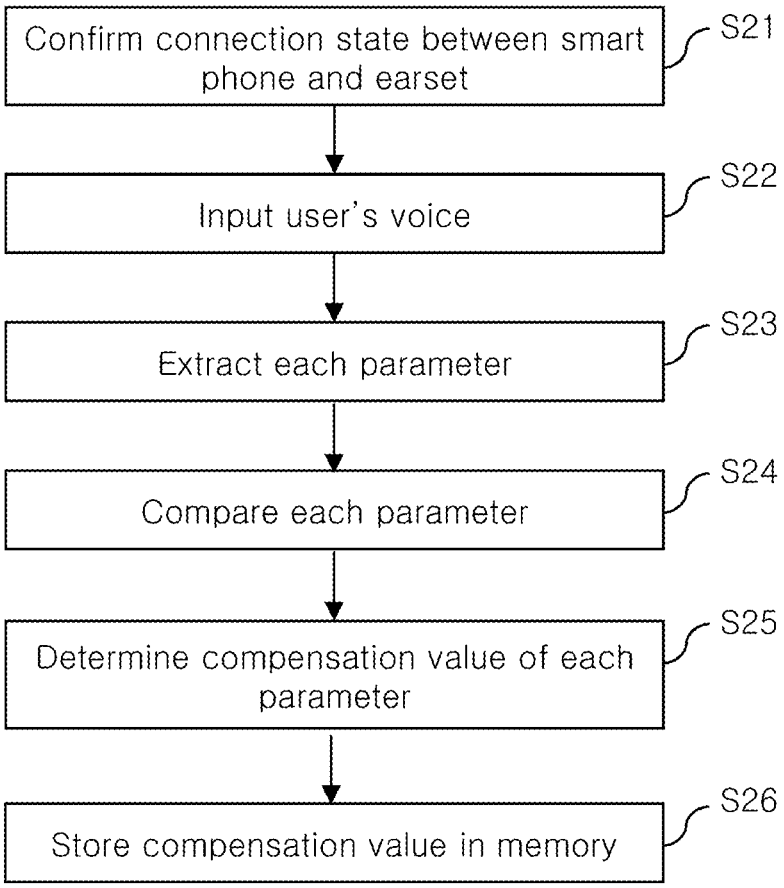
FIG. 8 is a view showing a process of accomplishing tone compensation through an App.

FIG. 8 is a view showing a process of accomplishing tone compensation through an App.

For example, it is a flowchart illustrating a process of setting parameter reference values and a process of accomplishing tone compensation, by executing an app in a smart phone or the like.

Referring to FIG. 8, a wired or wireless connection state between the smart phone and an earset is confirmed (step S21).

When the parameter reference values are not set, a process of setting the parameter reference values is performed.

A user's voice is inputted while the smart phone and the earset are connected (step S22). At this point, it is preferable to check a noise inputted from the out-ear microphone 2 before the user's voice is inputted, and input the user's voice when a noise value is lower than a set value.

If the app reads a guiding sentence, phase and amplitude parameters of each frequency are extracted from the voice signals outputted from the in-ear microphone 1 and the out-ear microphone 2 (step S23).

Subsequently, the extracted phase and amplitude parameters of each frequency of the in-ear microphone 1 are compared with the extracted phase and amplitude parameters of each frequency of the out-ear microphone 2 (step S24).

Then, a compensation value is determined on the basis of the phase and amplitude parameter values of each frequency of the out-ear microphone 2 for a parameter having a difference between measurement values (step S25).

Then, the compensation value is stored in the memory (step S26).

Then, the compensation value stored in the memory can be used for restoration of the voice. That is, voice restoration can be accomplished by applying the compensation value stored in the memory for the voice signal transferred from the in-ear microphone 1.

The technical spirit of the present invention has been described above through several embodiments.

It is apparent that those skilled in the art can diversely modify or change the embodiments described above from the description of the present invention. In addition, although it is not explicitly shown or described, it is apparent that those skilled in the art can make various forms of modifications including the spirit of the present invention from the description of the present invention, and this still falls within the scope of the present invention. The embodiments described above with reference to the accompanying drawings are described for illustrative purposes, and the scope of the present invention is not limited to the embodiments.

The invention claimed is:

1. A tone compensation device for an earset, the device comprising:

an in-ear microphone for collecting inner sound transferred from vocal cords to an eardrum of an ear;

a band extension unit for extending a band width of the inner sound collected by the in-ear microphone from inner sound of a low frequency band to inner sound of a high frequency band by changing a frequency of the low frequency band into a frequency of the high frequency band;

an out-ear microphone for collecting outer sound transferred from the vocal cords to an outside of a mouth; and a voice restoration unit for restoring a voice by comparing a plurality of parameters of a voice signal outputted from the band extension unit to a plurality of parameters of a voice signal transferred from the out-ear microphone, the voice restoration unit being configured to:

extract phase and amplitude parameters of each frequency from voice signals transferred from the band extension unit and the out-ear microphone;

compare the phase and amplitude parameters of each frequency extracted from the voice signal of the band extension unit to the phase and amplitude parameters of each frequency extracted from the voice signal of the out-ear microphone to thereby find phase and amplitude parameters that show differences; and responsive to finding the phase and amplitude parameters that show differences, determine compensation values based on the phase and amplitude parameters extracted from the voice signal of the out-ear microphone and compensate the phase and amplitude parameters extracted from the voice signal of the band extension unit using the compensation values.

2. The tone compensation device according to claim 1, wherein the band extension unit is configured to:

generate a wideband excitation signal using a super-narrowband signal included in the inner sound collected by the in-ear microphone;

generate an extended band signal that includes a high frequency band signal using the super-narrowband signal and filter the high frequency band signal to generate a filtered high frequency band signal;

synthesize the filtered high frequency band signal and the wideband excitation signal to generate a synthesized signal; and mix the synthesized signal with the super-narrowband signal.

3. The tone compensation device according to claim 2, wherein the band extension unit is configured to generate the wideband excitation signal by a spectrum folding technique or a Gaussian noise pass band conversion technique.

4. The tone compensation device according to claim 2, wherein the band extension unit is configured to multiply a frequency of the super-narrowband signal by an integer to generate the high frequency band signal.

5. The tone compensation device according to claim 1, wherein the compensation values are stored in a memory by the voice restoration unit.

* * * * *